US011706581B2

(12) United States Patent
Jacquet

(10) Patent No.: US 11,706,581 B2
(45) Date of Patent: Jul. 18, 2023

(54) SOUND SPATIALISATION METHOD

(71) Applicant: ARKAMYS, Levallois-Perret (FR)

(72) Inventor: Damien Jacquet, Paris (FR)

(73) Assignee: ARKAMYS

( * ) Notice: Subject to any disclaimer, the term of this patent is extended or adjusted under 35 U.S.C. 154(b) by 0 days.

(21) Appl. No.: 17/469,284

(22) Filed: Sep. 8, 2021

(65) Prior Publication Data

US 2022/0078573 A1 Mar. 10, 2022

(30) Foreign Application Priority Data

Sep. 9, 2020 (FR) ..... 2009123

(51) Int. Cl.
*H04S 7/00* (2006.01)

(52) U.S. Cl.
CPC ..... *H04S 7/302* (2013.01); *H04S 2400/15* (2013.01)

(58) Field of Classification Search
CPC .... H04S 2420/01; H04S 2420/03; H04S 7/30; H04S 7/302; H04S 2400/11
USPC ..... 381/310, 303, 22, 23
See application file for complete search history.

(56) References Cited

U.S. PATENT DOCUMENTS 5,521,981 A * 5/1996 Gehring ..... H04S 1/002 381/26
9,674,632 B2 * 6/2017 Xiang ..... G10L 19/008
9,792,709 B1 * 10/2017 Meier ..... G06T 11/60
9,913,065 B2 3/2018 Vautin et al.
2009/0316939 A1 12/2009 Matsumoto et al.
2014/0358565 A1 * 12/2014 Peters ..... G10L 19/002 704/500
2018/0217798 A1 * 8/2018 Urbach ..... G09G 3/001
2020/0314508 A1 * 10/2020 Waterman ..... H04N 21/44004

FOREIGN PATENT DOCUMENTS

WO 2008106680 9/2008

OTHER PUBLICATIONS

"Virtual Sound Source Positioning Using Vector Base Amplitude Panning", Ville Pulkki, Laboratory of Acoustics and Audio Signal Processing, Helsinki University of Technology, J.Audio Eng. Soc., vol. 45, No. 6, Jun. 1997.

* cited by examiner

*Primary Examiner* — Alexander Krzystan
(74) *Attorney, Agent, or Firm* — Perman & Green, LLP

(57) ABSTRACT

A sound spatialisation method includes determining digital processing parameters to be applied to sound signals to be broadcast by a set of at least two loudspeakers in order to reproduce a virtual sound source at a desired position, and restoring sound signals by the loudspeakers during which the digital processing parameters are applied to the sound signals. The sound spatialisation method also includes defining a trajectory defined by a set of N points, with two consecutive points of the trajectory being connected together by a curve, and positioning during which the desired position of the virtual sound source is defined on the trajectory.

7 Claims, 7 Drawing Sheets

[Fig. 1]
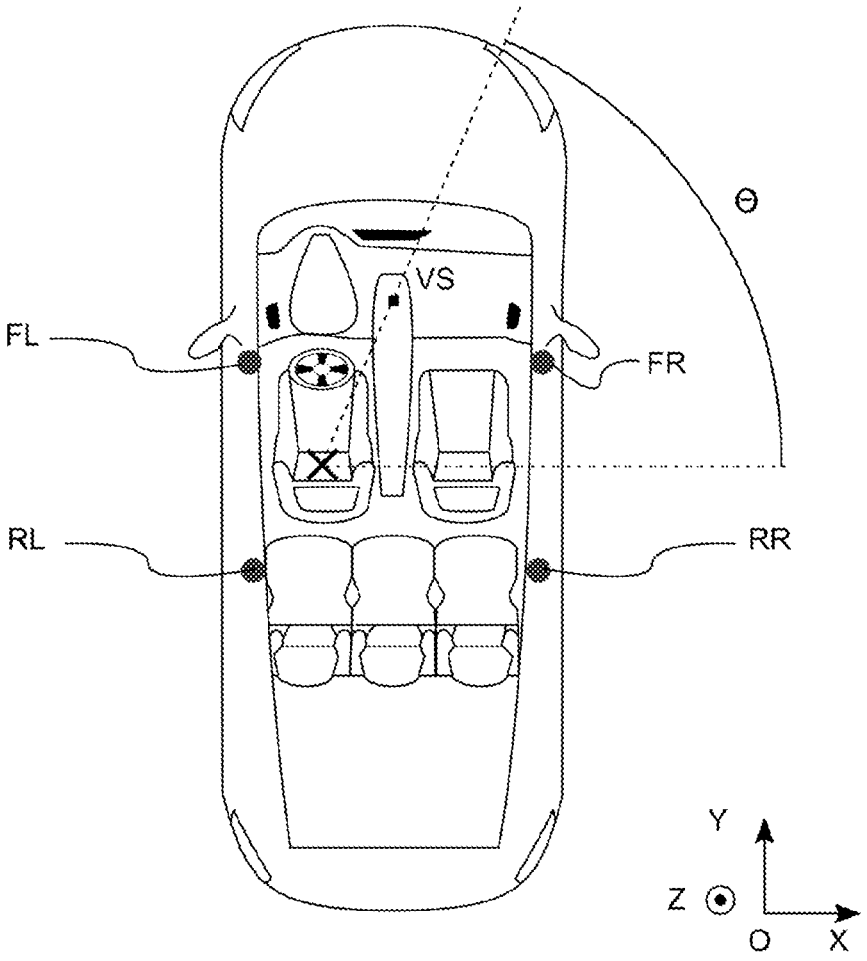

[Fig. 2A]
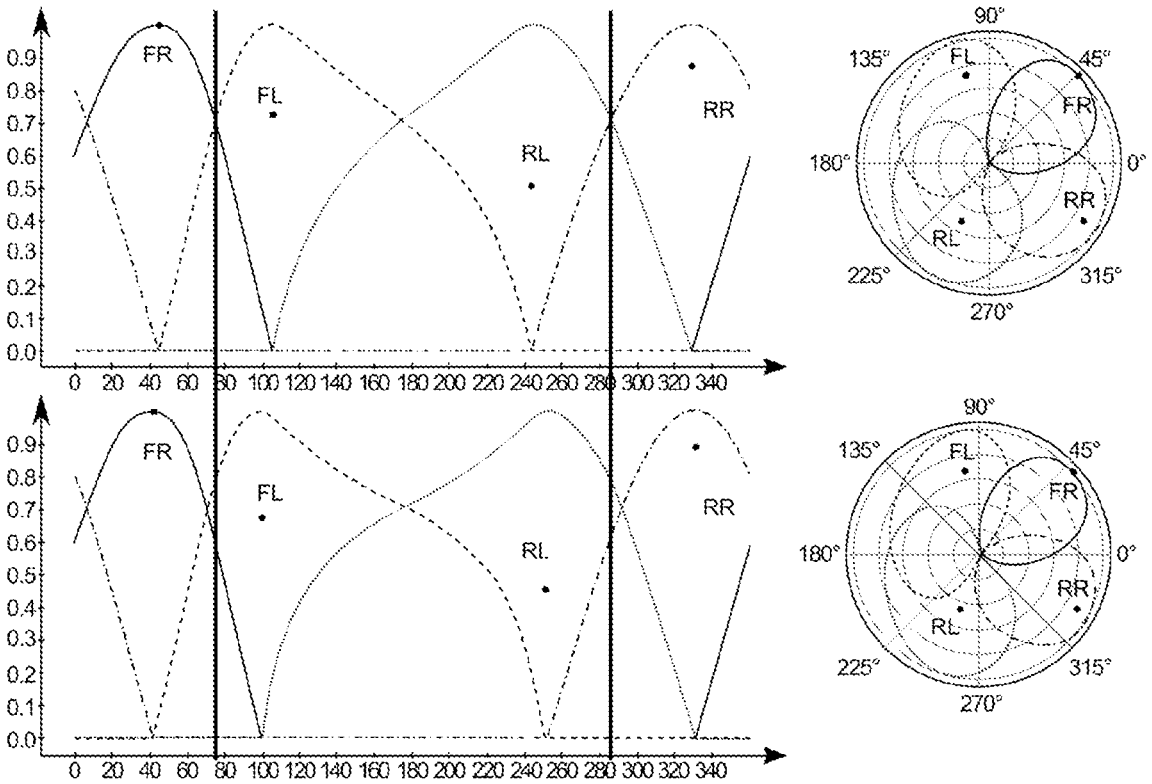
[Fig. 2B]
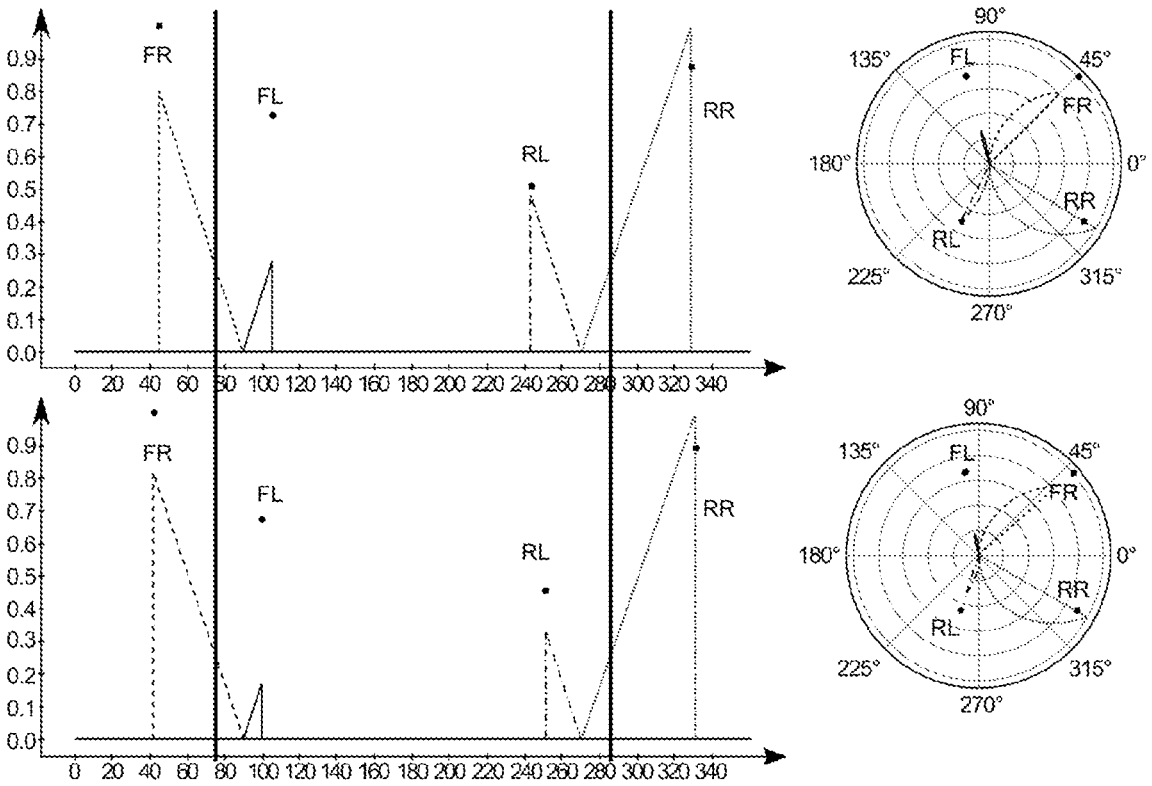

[Fig. 3]
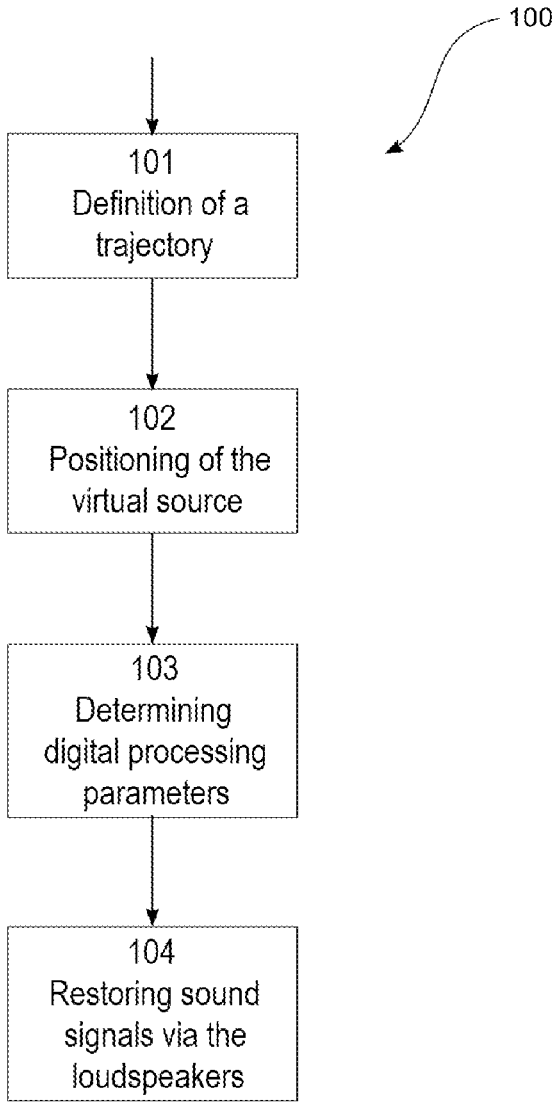

[Fig. 4]
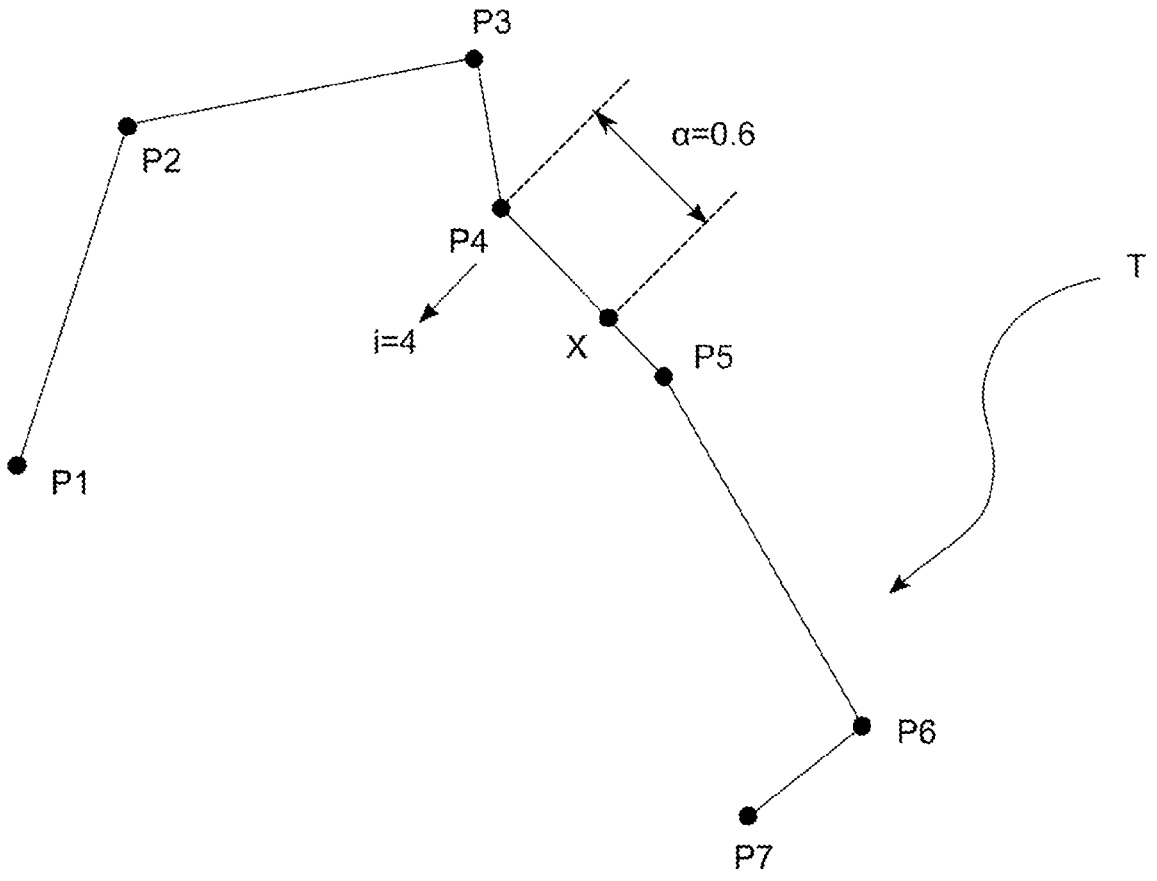

[Fig. 5A]
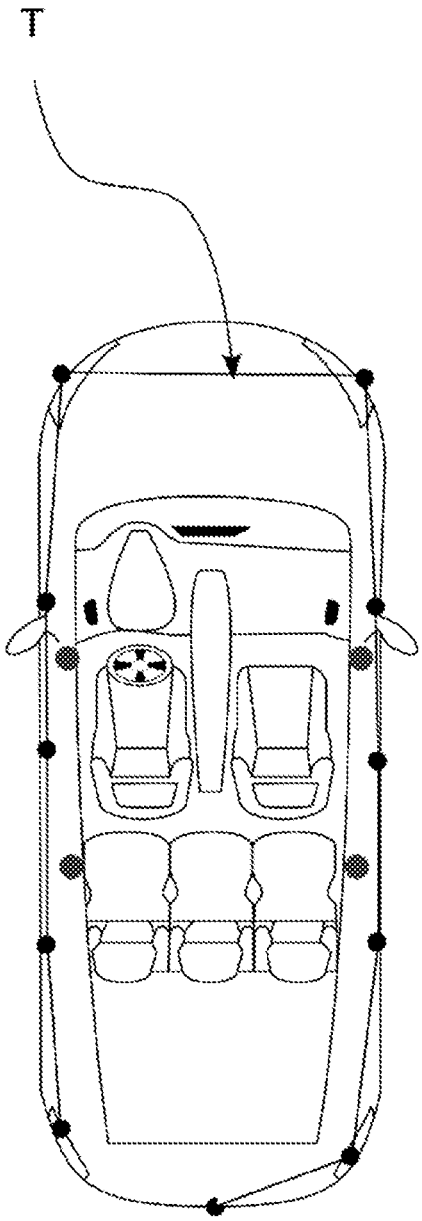

[Fig. 5B]
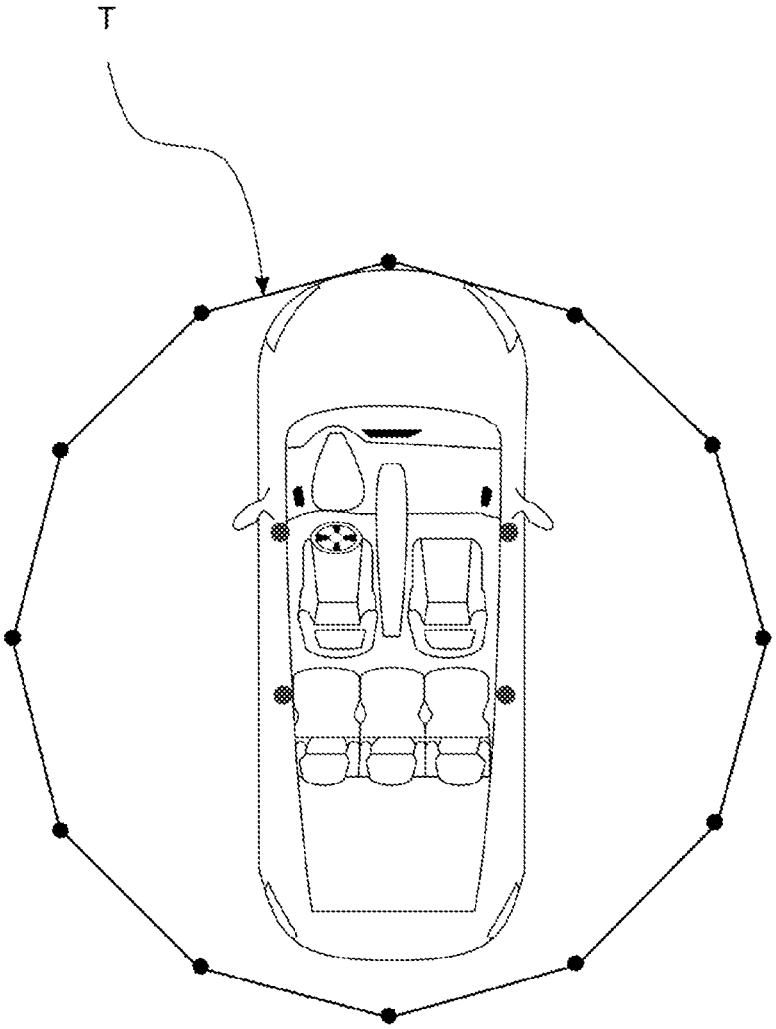

[Fig. 6A]
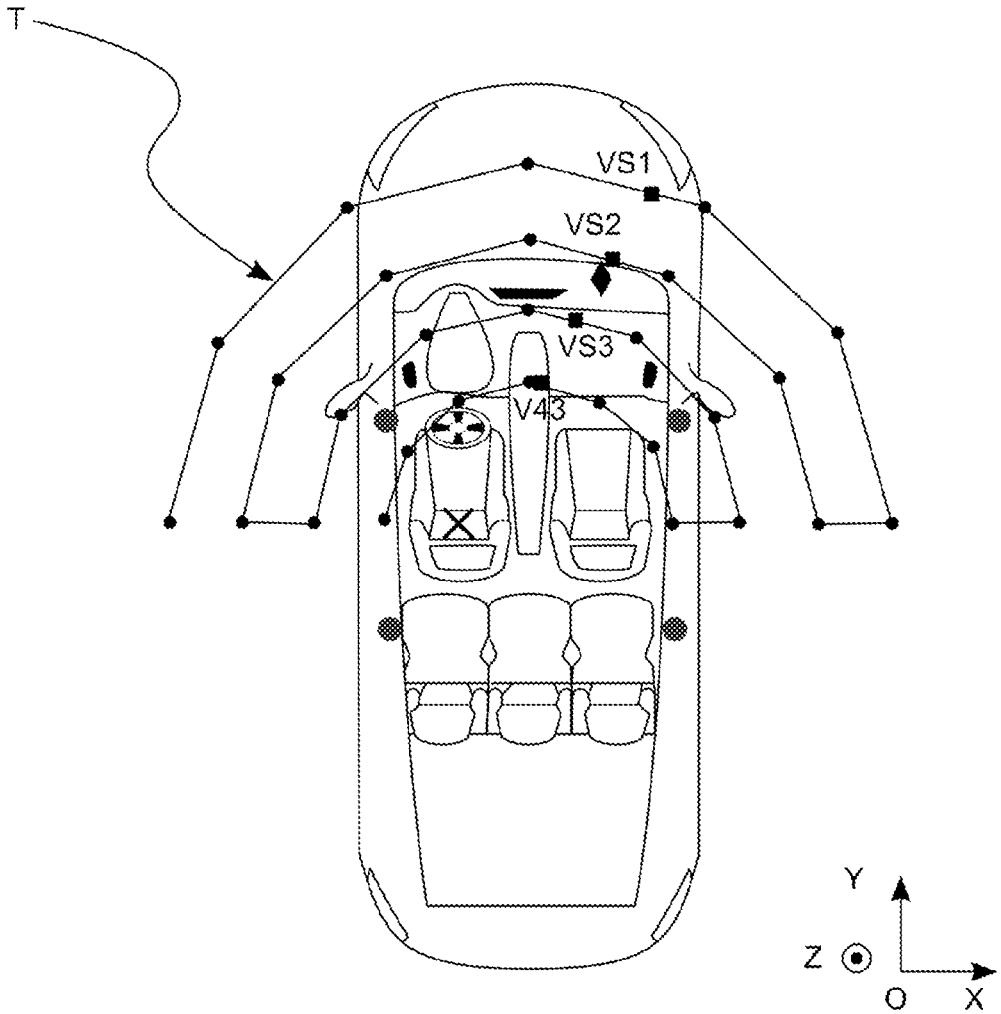
[Fig. 6B]
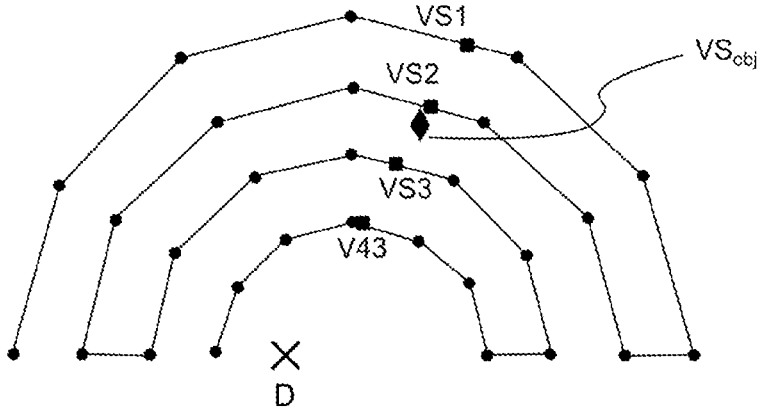

SOUND SPATIALISATION METHOD

CROSS-REFERENCE TO RELATED APPLICATIONS

This application claims priority to and the benefit of French patent application number FR 2009123 filed on Sep. 9, 2020, the disclosure of which is incorporated herein by reference in its entirety.

BACKGROUND

1. Field

The present disclosure relates to a sound spatialisation method.

The present disclosure has particular application in the field of stereophonic reproduction in the automotive context.

2. Brief Description of Related Developments

Sound spatialisation aims to create a sound environment around a listener in order to give them the impression that the sound they are perceiving is coming from a source located at a precise point of their environment.

There are several sound spatialisation methods, among which amplitude panning, delay panning.

Amplitude panning consists of playing with the intensities of the various sound sources (typically loudspeakers), so as to create a virtual sound source that can be displaced in the environment by varying the intensities of the sound sources. The VBAP (*Vector Base Amplitude Panning*) method, presented in "*Virtual Sound Source Positioning Using Vector Base Amplitude Panning", Ville Pulkki, Laboratory of Acoustics and Audio Signal Processing, Helsinki University of Technology*, makes it possible for example to recreate acoustic fields in two or three dimensions using any number of sound sources.

Delay panning takes account of the interaural time difference (ITD) in order to give an impression of a source located at a precise angle with respect to the head of the listener. This method applies to two sound sources (typically loudspeakers) located on either side of the plane of symmetry of the head of the user. A delay is applied to the signal broadcast by one of the two loudspeakers, in order to create a virtual source outside the plane of symmetry. The more substantial the delay is, the more substantial the angle formed by the virtual source and the plane of symmetry is.

Other methods exist in order to create a sound spatialisation. It is for example possible to play with the ratio between direct sound and reverberated sound in order to create an impression of distance, or on the contrary an impression of proximity. The impression of depth can also be provided using a low-pass filter that models the absorption by the air of the high frequencies.

However, most of the existing sound spatialisation technologies are sensitive to relative positioning errors between loudspeakers and the listener. Thus, a slight configuration error during the setting up of the sound spatialisation methods creates an erroneous perception of the position of the virtual source.

FIG. 1 shows a passenger compartment of a vehicle wherein four loudspeakers are disposed: a front left loudspeaker FL, a front right loudspeaker FR, a rear left loudspeaker RL and a rear right loudspeaker RR.

The position of the head of a listener, who is installed on the driver's seat, is symbolised by a cross.

FIG. 2A shows, in the form of Cartesian and polar diagrams, the amplitudes to be applied to the signals broadcast by each one the loudspeakers according to an angular position θ of a virtual source VS, symbolised by a solid square in FIG. 1, that is sought to be created:

- the amplitude curve to be applied to the front left loudspeaker FL is represented as an uninterrupted line;
- the amplitude curve to be applied to the front right loudspeaker FR is represented as a continuous line;
- the amplitude curve to be applied to the rear left loudspeaker RL is represented as a dotted line;
- the amplitude curve to be applied to the rear right loudspeaker RR is represented as a mixed line.

The angular position θ of the virtual source VS is defined as the angle formed by the straight lines passing through the head of the listener and the virtual source VS with the axis OX such as defined in FIG. 1.

The Cartesian or polar diagrams located in the upper portion of FIG. 2A show the amplitudes to be applied for a position of the head of the listener such as shown in FIG. 1.

The Cartesian or polar diagrams located in the lower portion show the amplitudes to be applied for a position of the head of the listener offset ten centimetres to the left with respect to its position in FIG. 1, i.e. by ten centimetres in the direction of the negative X-axis.

In the same way, FIG. 2B shows, in the form of Cartesian and polar diagrams, the delays to be applied to the signals broadcast by each one the loudspeakers according to the angular position θ of a virtual source VS that is sought to be created, in combination with the amplitudes shown in FIG. 2A.

The line conventions are the same as those of FIG. 2A.

Likewise, the Cartesian or polar diagrams located in the upper portion of FIG. 2B show the delays to be applied for a position of the head of the listener such as shown in figure The Cartesian or polar diagrams located in the lower portion show the delays to be applied for a position of the head of a listener offset by ten centimetres to the left with respect to its position in FIG. 1, i.e. by ten centimetres in the direction of the negative X-axis.

It can be observed, for example in FIG. 2A, that the creation of a virtual source having an angular position of 70°, based on a position of the head of the listener integrating an error of ten centimetres in the direction of the negative X-axis, corresponding on the Cartesian diagram of the lower portion at the intersection of the curves of the front left and right loudspeakers, corresponds in reality, according to the Cartesian diagram of the upper portion, to an angular position of 75°. An error of ten centimetres on the position of the head of the listener therefore here results in an angular offset of five degrees on the angular position of the virtual source. Thus, the driver perceives the virtual source with an angular position of 75° instead of the initially desired angular position of 70°.

SUMMARY

The present disclosure relates to a sound spatialisation method including:

a step of determining digital processing parameters to be applied to sound signals to be broadcast by a set of at least two loudspeakers in order to reproduce a virtual sound source at a desired position;

a step of restoring sound signals by the loudspeakers during which the digital processing parameters are applied to the sound signals; According to the present disclosure, the sound spatialisation method includes moreover:

a step of defining a trajectory defined by a set of N points, with two consecutive points of said trajectory being connected together by a curve;

a step of positioning during which the desired position of the virtual sound source is defined on said trajectory.

In an embodiment, the trajectory has the shape of a broken line, with the curves connecting the points being segments.

In an embodiment, the positioning of the virtual sound source is carried out using a position index IpX associated uniquely with any point X of the trajectory and defined by:

$$IpX = \frac{j-1+\alpha}{N-1} \quad \text{[Math 1]}$$

where α is a real number comprised between 0 and 1, and j an integer comprised between 1 and N−1.

In an embodiment, the positioning of the virtual sound source along the trajectory is carried out manually by an operator.

In an embodiment, the position of the virtual sound source is defined during the step of the positioning in the following way:

a set of projected images is determined, on the trajectory, of a position objective of the virtual sound source, by determining for each curve of said trajectory, an intersection, if it exists, between said segment and a straight line passing through a point defining a position of a listener and the position objective of the virtual sound source, said intersection then defining a potential virtual sound source;

if at least one potential virtual sound source exists, the position of the virtual sound source is defined as the potential virtual sound source that minimises a distance to the position objective of the virtual sound source.

In an embodiment, in the absence of a potential virtual sound source, one of the following actions is carried out:

the virtual sound source is positioned at a default position defined beforehand, for example at one metre in front of the listener;

the virtual sound source is positioned on the trajectory at a point that has an angular position that is the closest, with respect to the listener, to that of the position objective of the virtual sound source;

the trajectory is modified in order to cover a wider zone of interest, but comprising points in common with the initial trajectory.

In an embodiment, a movement of the virtual sound source position is predefined, along the trajectory, for a total movement duration $t_{total}$, according to the relationship:

$$IpX(t) = \frac{t}{t_{total}} \quad \text{[Math 2]}$$

where t is a variable designating the time and comprised between 0 and $t_{total}$.

The present disclosure also relates to a device for the implementation of the sound spatialisation method according to the present disclosure. According to the present disclosure, the device includes:

means for defining a trajectory;

means for determining a desired position of a virtual sound source on said trajectory;

means for determining digital processing parameters to be applied to sound signals to be broadcast by a set of at least two loudspeakers in order to produce a virtual sound source at a desired position;

means for applying the digital processing parameters to the sound signals;

means for restoring the sound signals to which the digital processing parameters have been applied.

BRIEF DESCRIPTION OF DRAWINGS

FIG. 1 shows a passenger compartment of a vehicle including four loudspeakers configured to reproduce a virtual sound source.

FIG. 2A shows, in the form of Cartesian and polar diagrams, the amplitudes to be applied to the signals broadcast by the loudspeakers of the vehicle of FIG. 1, according to the desired angular position of the virtual source, for two different positions of the head of a driver.

FIG. 2B shows, in the form of Cartesian and polar diagrams, the delays to be applied to the signals broadcast by the loudspeakers of the vehicle of FIG. 1, according to the desired angular position of the virtual source, for two different positions of the head of a driver.

FIG. 3 is a schematic representation of the method according to the present disclosure.

FIG. 4 is a representation of a trajectory having a shape of a broken line.

FIG. 5A is a representation of a trajectory T corresponding substantially to contour of a car in a horizontal plane.

FIG. 5B is a representation of a substantially circular trajectory T disposed around a car, in a horizontal plane.

FIG. 6A is a representation of a trajectory T and of a vehicle, with the trajectory making it possible to cover an angular sector of 180 degrees, and a distance to the driver of about five metres.

FIG. 6B is an isolated representation of the trajectory T of FIG. 6A.

DETAILED DESCRIPTION

The present disclosure is described in what follows in an automotive context, in particular in the framework of sound spatialisation inside the passenger compartment of a vehicle. Those skilled in the art will understand that the present disclosure can however be applied to an environment other than that of a vehicle.

The passenger compartment of the vehicle includes a set of at least two loudspeakers. In the examples shown, a number of four loudspeakers is retained, without this limiting the present disclosure which can be applied to a different number of loudspeakers.

In reference to FIG. 3, the method 100 according to the present disclosure includes a first step 101 of defining a trajectory.

During this first step 101, in a plane parallel to the ground a set of N points Pi defining a trajectory T is defined. The index i is here an muted integer index ranging from 1 to N.

The trajectory T here describes a shape of a broken line. Those skilled in the art will understand when reading the following that this broken line shape does not limit the present disclosure and that other types of trajectories can be used, for example two points of a trajectory could be connected together by an arc of circle.

Each point Pi is defined by its coordinates in the plane, namely an x-coordinate $Pi_x$ and a y-coordinate $Pi_y$, which is written in matrix format:

$$P_i = \begin{bmatrix} Pi_x \\ Pi_y \end{bmatrix} \quad \text{[Math 3]}$$

Any point X belongs to the trajectory T if and only if there is a pair (α;j) such that:

$$X=P_j+\alpha(P_{j+1}-P_j) \quad \text{[Math 4]}$$

Where α is a real number comprised between 0 and 1, and j an integer comprised between 1 and N−1.

FIG. 4 shows a trajectory T defined by seven points, and the position of any point X referenced by the pair (0.6;4).

A position index IpX is advantageously defined making it possible to uniquely reference any point X on the trajectory T:

$$IpX = \frac{j-1+\alpha}{N-1} \quad \text{[Math 5]}$$

The coordinates of the point X can be found by applying the following formulas:

$$j=E(IpX\times(N-1))$$

$$\alpha=IpX-j$$

$$X=P_j+\alpha(P_{j+1}-P_j) \quad \text{[Math 6]}$$

Where E(.) designates the integer part operator.

Advantageously, the points Pi of the trajectory are placed in such a way that notable elements of the vehicle such as for example the centre of the steering wheel or the gear lever correspond to notable values of the position index IpX, for example a position index IpX equal to 0.1 or 0.5.

The method 100 then includes a second step 102 of positioning a virtual source VS on the trajectory T.

The positioning of the virtual source VS on the trajectory T is carried out by manually setting by an operator, or automatically, as shall be detailed in what follows, the position index IpX.

The method 100 then includes a third step 103 of determining digital processing parameters to be applied to the signals to be broadcast by the loudspeakers.

Determining digital processing parameters is carried out by means of techniques known to those skilled in the art of sound spatialisation, such as for example delay panning and amplitude panning.

The digital processing parameters can include for example gains, delays, filters, and depend in particular on the position of the source VS and on the geometry of the vehicle passenger compartment.

The method 100 then includes a fourth step 104 of restoring sound signals by the loudspeakers, based on parameters determined in the preceding step, which are applied to the signals to be broadcast by the loudspeakers.

The present disclosure shall now be detailed in the framework of three particular embodiments.

In a first embodiment, the present disclosure is applied in the context of static sounds.

The term "static sounds" means sounds of which the sound localisation or sound scene, is assumed to be invariable during the use of the vehicle.

This can be for example:

music listened to from a CD-ROM or mp3 player of the vehicle, for which the sound scene is generally placed towards the front of the vehicle;

sound signals linked to driving, for example an indicator located near the steering wheel.

In these cases here, a particular sound scene objective is sought, and a trajectory T is advantageously used in order to allow a first operator to place the virtual source VS manually, by varying the position index IpX, with a second operator evaluating the sound rendition from inside the vehicle.

The second operator can be installed indifferently on the driver's seat or on a passenger seat, according to the objective sought.

The trajectory T is defined in such a way that it covers an angular sector that is sufficiently substantial with respect to the second operator so as to allow them to evaluate a wide range of positions of the virtual source VS, so as to select the one that they feel is the most pertinent, i.e. the most in coherence with the sound scene objective sought.

Advantageously, the trajectory T also allows the first operator to vary the radial distance from the virtual source VS to the second operator in such a way as to adjust the reverberation perceived by said second operator.

The virtual source VS is then displaced along the trajectory T by the first operator, for example by varying by means of an interface operator the pair (α;j) or more simply the associated position index IpX uniquely with a position on the trajectory T.

The displacement of the virtual source VS can be carried out continuously or discretely.

The virtual source VS is stopped at the position judged by the second operator as the most pertinent with regards to the objective sought.

The steps of determining digital processing parameters 103 and of restoring signals by the loudspeakers 104 are then applied.

In a second embodiment, the present disclosure is applied in real time.

This entails creating the sound spatialisation of sounds of which a sound localisation is desired to be variable during the use of the vehicle.

For example, a sound signal can be issued in order to warn the driver of a potential danger in the environment of the vehicle, the sound localisation being able to change so as to adapt to the position of the danger in said environment. This can be for example to warn the driver of the presence of a pedestrian or of a vehicle in a blind spot.

In this embodiment, the sound localisation is not defined a priori and is able to change with time, for example in order to follow the displacement of the pedestrian or of the vehicle.

Consequently, in this aspect the position of the virtual source VS is approximated as shall be seen in what follows, in order to take account of a parameter P provided by an auxiliary system, typically an advanced driver-assistance system (ADAS).

The trajectory T is here defined so as to cover the angular sector and the distance to the driver as wide as possible according to the assumed zone wherein the virtual sound source VS is supposed to be found approximately.

By way of example, in reference to FIG. 5A, a trajectory T corresponding substantially to a contour of the car in a horizontal plane is defined.

In the example shown, the points Pi correspond to notable elements of the vehicle, in order to facilitate the implementation of the method for an operator, in particular:

IpX=0; Left tail light;

IpX=0.5; Right front light;

IpX=1; Rear central point of the car;

The trajectory T can also have a substantially circular shape, as shown in FIG. 5B. These two examples make it possible to cover an angular sector of 360 degrees.

In reference to FIGS. 6A and 6B, a trajectory T is defined making it possible to cover an angular sector of 180 degrees, and a distance to the driver of about five metres.

In order to position the virtual source VS, the parameter P is provided by the auxiliary system in order to establish a position objective $VS_{obj}$ of the virtual sound source VS.

By way of example, the position objective $VS_{obj}$ of the virtual sound source can substantially correspond to the position of a pedestrian located in the environment of the vehicle, position provided by a sensor.

The positioning of the virtual source VS is detailed hereinafter.

In FIGS. 6A and 6B, the position objective $VS_{obj}$ of the virtual sound source is represented by a diamond.

A cross represents a position D of the head of a listener, who is installed on the driver's seat.

During the step 102 of positioning the virtual source VS, a projection of the position objective $VS_{obj}$ of the virtual sound source on the trajectory T is determined.

For each segment of ends Pi and Pi+1 of the trajectory T, if it exists, an intersection is determined between said segment and a segment connecting a position of the listener and the position objective $VS_{obj}$ of the virtual sound source. Each point of intersection thus defines a potential virtual source VSi. A set of M intersection points defining M potential virtual sources is thus obtained.

In the case shown in FIGS. 6A and 6B, a set of four potential virtual sources VS1, VS2, VS3, VS4 appears, symbolised by squares.

The position of the virtual source VS is then determined as being the potential virtual source VSk of index k having the minimum distance to the position objective $VS_{obj}$ of the virtual sound source i.e. that satisfies:

$$d(VSk;\ VS_{obj}) = \min_{i\in[1;M]} d(VSi;\ VS_{obj}) \qquad \text{[Math 7]}$$

In the description, the virtual source VSk thus obtained is called "projection" of the position objective $VS_{obj}$ of the virtual sound source on the trajectory T.

The position index IpVS of the virtual source VS is defined in what follows in the following way:

$$lpVS = \frac{k-1+t_2}{N-1} \qquad \text{[Math 8]}$$

$$t_2 = \frac{(D_y - VS_{obj_y})(D_x - A_x) + (VS_{obj_x} - D_x)(D_y - A_y)}{(B_x - A_x)(D_y - VS_{obj_y}) + (D_x - VS_{obj_x})(B_y - A_y)}$$

$$A = P_k$$

$$B = P_{k+1}$$

where the index x refers to an x-coordinate of the associated point and the index here refers to a y-coordinate of the associated point.

In reference to FIG. 6B, the virtual source thus determined is the virtual source VS2.

In the case where no intersection exists between the trajectory T and the virtual line connecting the driver D to the position objective $VS_{obj}$ of the virtual sound source VS, it can be considered:

to not implement the following steps 103 and 104, with the position objective $VS_{obj}$ of the virtual sound source VS being considered as outside a zone of interest;

to locate the sound at a default position, for example in front of the listener;

the sound is generated in an angular position closest, with respect to the driver, to that of the position objective $VS_{obj}$ of the virtual sound source VS;

the trajectory is artificially modified to cover a wider zone of interest, but comprising points in common with the initial trajectory.

Once the virtual source VS is determined, the steps of determining digital processing parameters 103 and od restoring signals by the loudspeakers 104 are then applied.

Of course, the position of the virtual source VS is able to change with time according to a change in the position objective $VS_{obj}$ of the virtual sound source VS, for example a displacement and the second step 102 of positioning the virtual source VS and the subsequent steps are therefore applied iteratively during the implementation of the method according to the present disclosure.

In a third embodiment, the present disclosure is applied to a predefined displacement of the virtual source VS along a trajectory T.

In this embodiment, the positioning of the virtual source VS during the second step 102, as well as the subsequent steps of determining digital processing parameters 103 and of restoring sound signals by the loudspeakers 104, are applied iteratively during the implementation of the method according to the present disclosure, the position of the virtual source VS being a function of time.

A starting position (i.e. corresponding to the starting of the movement) and an arrival position (i.e. corresponding to the end of the movement) of the virtual source VS are any two points of the trajectory defined arbitrarily, for example the starting positions corresponds to the point P1, and the arrival position to the point PN.

In this embodiment, the position index IpX and a displacement speed Sp of the virtual source VS along the trajectory T are given by the following formulas:

$$IpX(t) = \frac{t}{t_{total}} \qquad \text{[Math 9]}$$

$$Sp(t) = \frac{N\sqrt{(P_{l+1} - P_l)^T (P_{l+1} - P_l)}}{t_{total}}$$

$$l = E\left((N-1)\frac{t}{t_{total}}\right)$$

where:

t is a variable representing time, comprised between 0 and $t_{total}$;

$t_{total}$ designates the total duration of the movement;

E(.) designates the integer part operator.

This results in that the displacement speed Sp changes over time like a constant staircase function between two consecutive points of the trajectory T, and is as substantial as the distance between the two points is substantial.

The temporal change in the position index is here considered as linear in relation to time, but those skilled in the art will understand that the latter can have a more generic form:

$$IpX(t)=f(t) \qquad \text{[Math 10]}$$

Where f designates any a priori function.

It should be noted that although the implementation of the present disclosure was described hereinabove with only a single trajectory, several trajectories can be defined during the first step 101.

The positioning of the virtual source VS is then considered over the set of trajectories defined, by considering the positioning on each one of the trajectories separately.

For example, in the case of a sound spatialisation in real time described hereinabove in the second embodiment, the projection of the position of the position objective $VS_{obj}$ of the virtual sound source VS is carried out over the set of trajectories, and the position of the virtual source is determined by considering the potential virtual source that is closest to the position objective $VS_{obj}$ of the virtual sound source VS, all trajectories taken as a whole.

The present disclosure also relates to a sound spatialisation device for the implementation of the method according to the present disclosure.

The sound spatialisation device according to the present disclosure comprises means for:

defining a set of points defining a trajectory T;

positioning the virtual source VS on the trajectory T;

determining digital processing parameters to be applied to the signals to be broadcast by the loudspeakers;

restoring the sound signals.

The present disclosure also makes it possible to place virtual sound sources with precision in an environment of a listener, in order to create a sound spatialisation.

Using trajectories makes it possible to apply the present disclosure to various applications, in particular driver-assistance static sounds, alerts coming as a supplement from an advanced driver-assistance system, or sound sources being displaced along predefined trajectories.

It should be noted that, although the trajectory is defined in what is described hereinabove during the first step 101 of defining a trajectory, it can be adjusted all throughout the method dynamically if needed, which makes it possible to use the present disclosure in real time.

The present disclosure, described here in the framework of a 2D application, can be applied mutatis mutandis to the context of a sound spatialisation in three dimensions, with the principles and equations implemented being similar to those described hereinabove in the framework of an application in two dimensions.

Those skilled in the art will understand that the present disclosure is not limited to the automobile field for which said present disclosure has been described, but can be applied more generally to any field implementing a sound spatialisation, for example music or cinema.

What is claims is:

1. Sound spatialisation method including:

a step of determining digital processing parameters to be applied to sound signals to be broadcast by a set of at least two loudspeakers in order to reproduce a virtual sound source at a desired position;

a step of restoring sound signals by the loudspeakers during which the digital processing parameters are applied to the sound signals; said sound spatialisation method being characterised in that it includes moreover:

a step of defining a trajectory defined by a set of N points, with two consecutive points of said trajectory being connected together by a curve;

a step of positioning during which the desired position of the virtual sound source is defined on said trajectory, wherein the position of the virtual sound source is defined during the step of the positioning in the following way:

a set of projected images is determined, on the trajectory, of a position objective of the virtual sound source, by determining for each curve of said trajectory, an intersection, if it exists, between said segment and a straight line passing through a point defining a position of a listener and the position objective of the virtual sound source, said intersection then defining a potential virtual sound source;

if at least one potential virtual sound source exists, the position of the virtual sound source is defined as the potential virtual sound source minimising a distance to the position objective of the virtual sound source.

2. Sound spatialisation method according to claim 1 characterised in that the trajectory has the shape of a broken line, with the curves connecting the points being segments.

3. Sound spatialisation method according to claim 2 characterised in that the positioning of the virtual sound source is carried out using a position index IpX associated uniquely with any point X of the trajectory and defined by:

$$IpX = \frac{j - 1 + \alpha}{N - 1}$$

where α is a real number comprised between 0 and 1, and j an integer comprised between 1 and N−1.

4. Sound spatialisation method according to claim 1 characterised in that the positioning of the virtual sound source along the trajectory is carried out manually by an operator.

5. Sound spatialisation method according to claim 1 characterised in that, in the absence of a potential virtual sound source, one of the following actions is carried out:

the virtual sound source is positioned at a default position defined beforehand, for example at one metre in front of the listener;

the virtual sound source is positioned on the trajectory at a point that has an angular position that is the closest, with respect to the listener, to that of the position objective of the virtual sound source;

the trajectory is modified in order to cover a wider zone of interest, but comprising points in common with the initial trajectory.

6. Sound spatialisation method according to claim 3 characterised in that a movement of the virtual sound source position is predefined, along the trajectory, for a total movement duration $t_{total}$, according to the relationship:

$$IpX(t) = \frac{t}{t_{total}}$$

where t is a variable designating the time and comprised between 0 and $t_{total}$.

7. Device for implementing the sound spatialisation method according to claim 1, said device being characterised in that it includes:

means for defining a trajectory;

means for determining a desired position of a virtual sound source on said trajectory;

means for determining digital processing parameters to be applied to sound signals to be broadcast by a set of at least two loudspeakers in order to produce a virtual sound source at a desired position;

means for applying the digital processing parameters to the sound signals;

means for restoring the sound signals to which the digital processing parameters have been applied.

* * * * *